US008261912B1

(12) United States Patent
Ingrey-Senn

(10) Patent No.: US 8,261,912 B1
(45) Date of Patent: Sep. 11, 2012

(54) HANGTAG FOR A TOOL SOCKET

(75) Inventor: Charles Ingrey-Senn, Odell (GB)

(73) Assignee: Dap Limited, Hong Kong (CN)

( * ) Notice: Subject to any disclaimer, the term of this patent is extended or adjusted under 35 U.S.C. 154(b) by 0 days.

(21) Appl. No.: 13/068,277

(22) Filed: May 6, 2011

Related U.S. Application Data

(60) Provisional application No. 61/395,326, filed on May 11, 2010.

(51) Int. Cl.
*B65D 85/20* (2006.01)
*A47F 7/00* (2006.01)

(52) U.S. Cl. ..... 206/378; 206/349; 206/806; 211/70.6; 248/317

(58) Field of Classification Search ..... 206/349, 206/378, 493, 806; 211/70.6; 248/309.1, 248/314, 317
See application file for complete search history.

(56) References Cited

U.S. PATENT DOCUMENTS

| | | | | |
|---|---|---|---|---|
| 4,043,453 | A | 8/1977 | Greenlee | |
| 4,433,498 | A | 2/1984 | Bienz | |
| D297,651 | S | 9/1988 | Merl | |
| 5,425,519 | A | 6/1995 | Budert | |
| 5,740,911 | A | 4/1998 | Chou | |
| 5,862,913 | A | 1/1999 | Chou | |
| 6,032,797 | A | 3/2000 | Kao | |
| 6,415,933 | B1 | 7/2002 | Kao | |
| 6,581,894 | B1 | 6/2003 | Tong | |
| 6,634,501 | B2 | 10/2003 | Su et al. | |
| 6,672,555 | B2 | 1/2004 | Chang | |
| D495,596 | S | 9/2004 | Trettin | |
| D497,105 | S | 10/2004 | Trettin | |
| D497,800 | S | 11/2004 | Trettin | |
| D519,362 | S | 4/2006 | Lee et al. | |
| 7,111,422 | B2 | 9/2006 | Wheeler | |
| 7,121,031 | B2 | 10/2006 | Wheeler | |
| 7,124,900 | B2 | 10/2006 | Hu | |
| 7,210,663 | B2 | 5/2007 | Wheeler et al. | |
| 7,264,213 | B2 | 9/2007 | Liu | |
| 7,287,644 | B2 | 10/2007 | Chen | |
| 7,296,772 | B2 | 11/2007 | Wang | |
| D563,209 | S | 3/2008 | Samelson | |
| 7,603,803 | B2 | 10/2009 | Wheeler et al. | |
| 7,669,723 | B2 * | 3/2010 | Kao | 211/70.6 |
| 7,717,278 | B2 * | 5/2010 | Kao | 211/70.6 |
| 7,753,216 | B2 * | 7/2010 | Kao | 211/70.6 |
| 2005/0230587 | A1 * | 10/2005 | Yang | 248/314 |

* cited by examiner

*Primary Examiner* — Bryon Gehman
(74) *Attorney, Agent, or Firm* — John P. McGonagle

(57) ABSTRACT

A hangtag for a tool socket is provided. The hangtag has a body board connected to a fixing device which is inserted into and holds a tool socket. The hangtag is adapted to being displayed vertically with the body board being removably attached to a display rack hook and the fixing device with tool socket being attached to and suspended beneath the body board.

7 Claims, 4 Drawing Sheets

FIG. 3
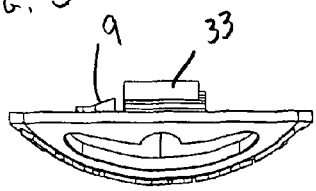
FIG. 4
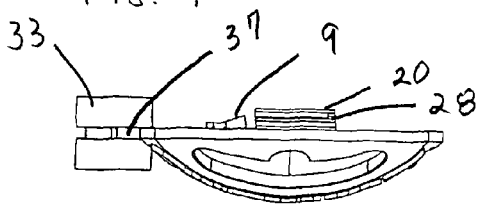
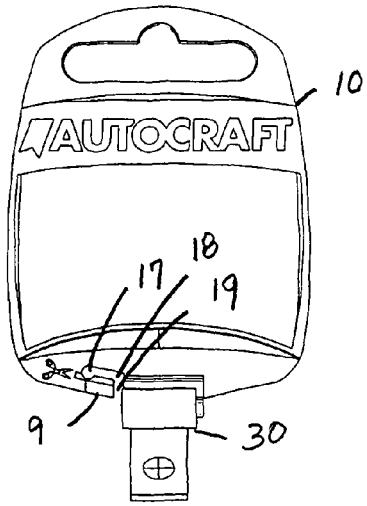
FIG. 5
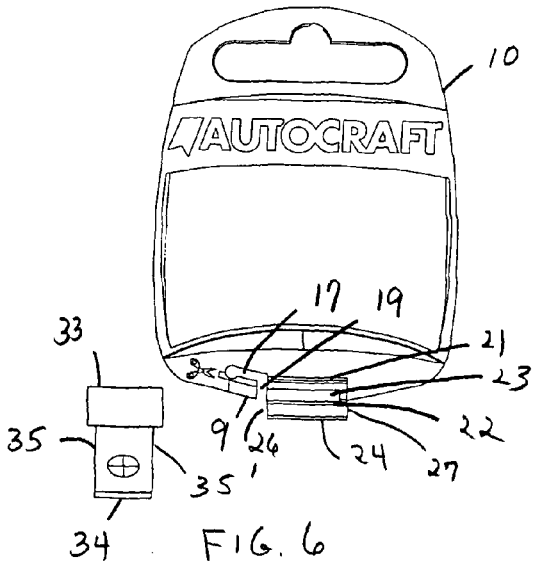
FIG. 6
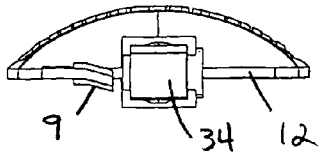
FIG. 7
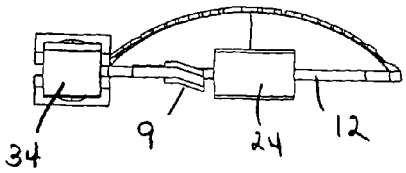
FIG. 8

HANGTAG FOR A TOOL SOCKET

RELATED U.S. APPLICATION DATA

Applicant claims the priority benefits of U.S. provisional Patent Application No. 61/395,326, filed May 11, 2010.

BACKGROUND OF THE INVENTION

This invention relates to a display suspension device, and in particular, to a hangtag for a tool socket.

Various kinds of suspension display devices have been developed for attaching to articles for sales, and for displaying the articles. Prior art suspension devices have been developed comprising a body board with an elongated slot for hooking onto a hook or the like of a displaying rack. The bottom edge of the board has a neck portion extended to form a fixing device for mounting with an insertion hole of a mounting work piece, i.e., a tool socket. The fixing device is provided with recessed or protruded position body so that the suspension device can be easily mounted with the work piece.

The drawback for these types of devices is that a separate board/fixing device combination must be molded for each different socket size. It would be desirable to separate the board from the fixing device and provide a universal board, which could be inserted into a fixing device of any size. Only the fixing device would thereby have to be adjusted for different socket sizes.

SUMMARY OF THE INVENTION

The present invention solves some of the aforementioned problems by providing a universal body board, which is slidably fitted into a tool socket fixing device, thereby forming a hangtag for tool sockets.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

FIG. 3 is a top view of the invention shown in FIG. 1.

FIG. 4 is a top view of the separated invention shown in FIG. 2.

FIG. 5 is a front view of the invention shown in FIG. 1.

FIG. 6 is a front view of the separated invention shown in FIG. 2.

FIG. 7 is a bottom view of the invention shown in FIG. 1.

FIG. 8 is a bottom view of the separated invention shown in FIG. 2.

DETAILED DESCRIPTION OF INVENTION

Figure 2:
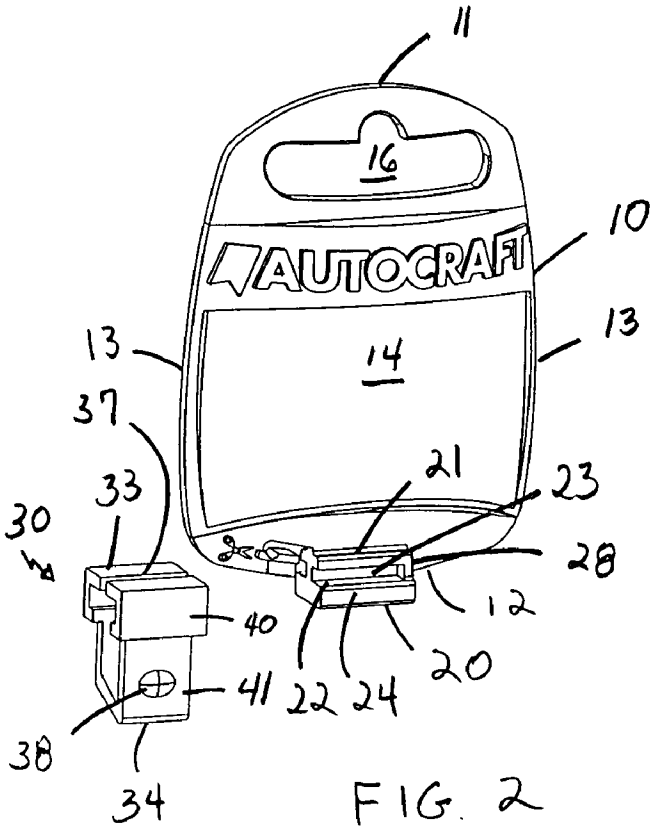
FIG. 2 is a front perspective view of the invention hangtag with body board and tool socket fixing device separated.
Figure 1:
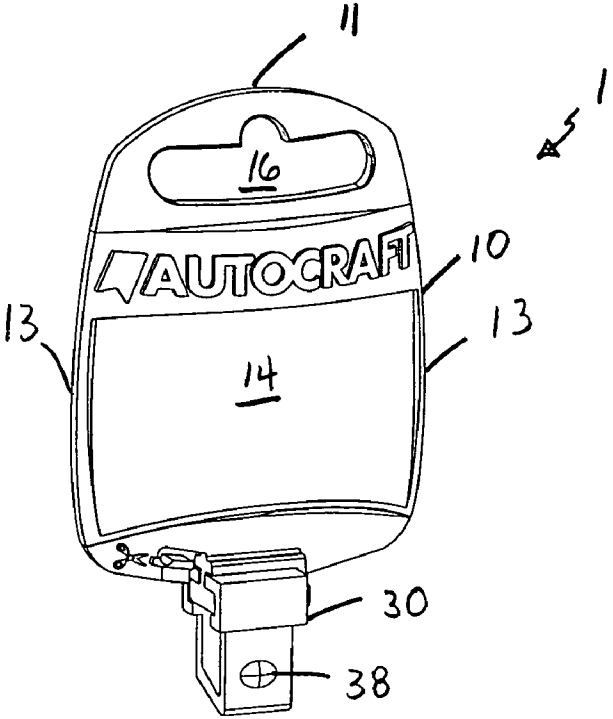
FIG. 1 is a front perspective view of the invention hangtag.
Figure 10:
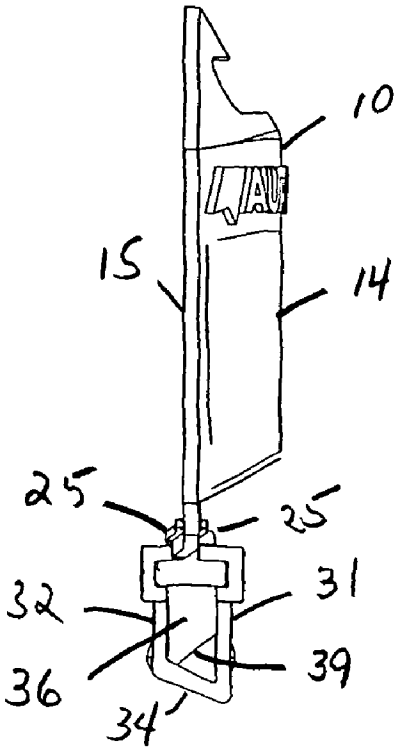
FIG. 10 is a left side view of the invention.
Figure 9:
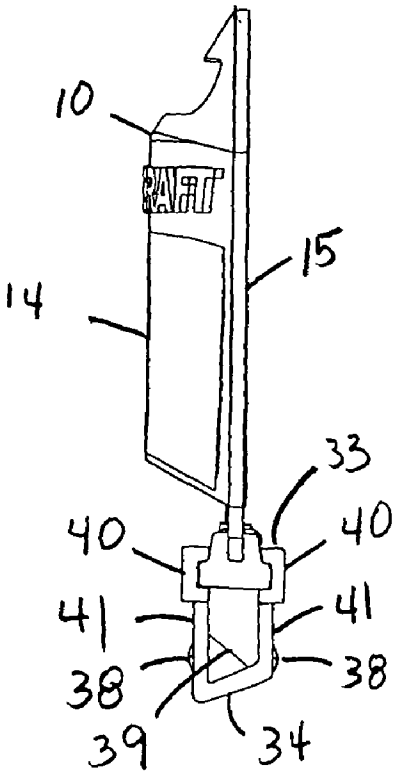
FIG. 9 is a right side view of the invention.
Figure 11:
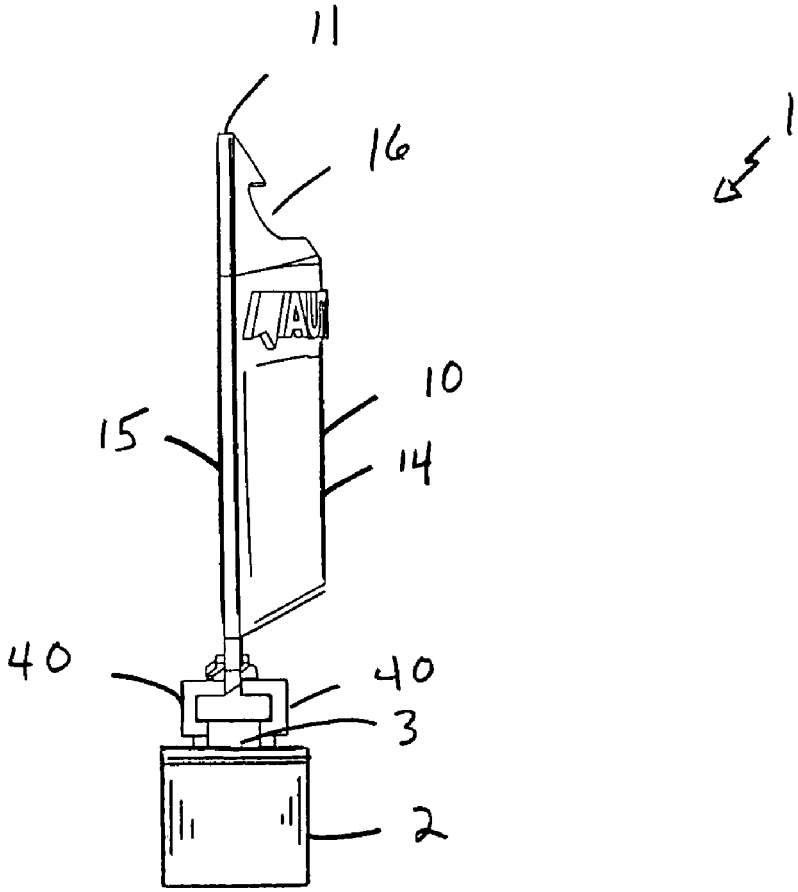
FIG. 11 is a left side view of the invention with a socket attached to the socket fixing device.

Referring to the drawings in detail wherein like elements are indicated by like numerals, there is shown a hangtag 1 for a tool socket 2, said hangtag being comprised of a body board 10 connected to a fixing device 30 which is inserted into and holds a tool socket 2. The hangtag 1 is adapted to being displayed vertically with the body board 10 being removably attached to a display rack hook (not shown) and the fixing device 30 with tool socket being attached to and suspended beneath the body board 10.

The body board 10 is a planar element adapted to being displayed in a vertical plane. The body board 10 has a top 11, a bottom 12, two opposite sides 13, a front surface 14 and an opposite rear surface 15. The body board 10 may have a vertical convex shape so that the front surface 14 is bent outwardly. An elongated, horizontal slot 16 is formed in the body board 10 near to the body board top 11, said elongated slot 16 providing means for hooking the body board 10 onto a hook or the like of a display rack.

The body board bottom 12 terminates in a t-rail 20 having a top 21, a foot 22, and a web 23 interconnecting said top and foot. The t-rail 20 has a proximal end 26 and a distal end 27, the distance between the proximal end and distal end defining a t-rail width. The foot 22 has a bottom flange 24 formed thereon. The t-rail 20 has a horizontal linear ridge 25 on both body board surfaces 14, 15 along the t-rail top 21, said horizontal ridges 25 being parallel to the t-rail foot 22. The t-rail distal end 27 has a vertical ridge 28 formed on both body board surfaces 14, 15 interconnecting said t-rail top 21 and flange 24. The body board 10 has a horizontal channel 17 near to the body board bottom 12 adjacent the t-rail proximal end 26. The horizontal channel 17 opens vertically downward at its innermost end 18 to the body board bottom 12 alongside the t-rail proximal end 26. The horizontal channel 17 and vertical downward opening 19 form a body board bottom tab detent 9 as described more fully below.

As stated above, the hangtag 1 is further comprised of a fixing device 30 which is inserted into and holds a tool socket 2. Tool sockets 2 are generally cylindrical in shape and have central vertical openings 3 of various sizes and configurations for attachment to a tool socket holder (not shown). The tool socket openings 3 will typically have a semi-spherical indentation for engagement to a spherical spring in a tool socket holder. The fixing device 30 is adapted to partially fit into the tool socket opening 3 and provide means for attachment to a body board 10. The fixing device 30 is comprised of a front element 31, rear element 32, top 33, bottom element 34, and two open sides 35, said front, rear, top and bottom defining a fixing device interior 36. The fixing device top 33 is split with a central aperture 37 extending from one open side 35 to the other open side 35'. The fixing device front element 31 has a generally rectangular shape extending vertically downward a designated distance to the fixing device bottom element 34. The fixing device rear element 32 also has a generally rectangular shape extending vertically downward a designated distance less than that of the fixing device front element 31. The fixing device bottom element 34 slants upward from the fixing device front element 31 to the fixing device rear element 32. The fixing device front element 31 and rear element 32 each have an external circular protrusion 38 corresponding to a typical tool socket indentation within the tool socket opening 3. The fixing device interior 36 has a triangular bracing element 39 interconnecting the fixing device bottom element 34 and front element 31.

The fixing device front element 31 and rear element 32 have upper portions 40 which have identical widths, said widths being approximately equal to the t-rail width as defined above. The fixing device front element 31 and rear element 32 have lower portions 41 which may have the same side-to-side width of the upper portion or may be of a lesser width depending upon the size of a particular tool socket opening. The circular protrusions 38 are formed on the lower portions 41. Only the lower portions 41 are inserted into the tool socket opening 3.

In operation, the fixing device is attached to the body board 10 by slipping the fixing device top central aperture 37 onto the t-rail web 23. The fixing device top 21 will fit between the t-rail horizontal ridges 25 and flange 24. The fixing device top 21 is horizontally held in place by the t-rail vertical ridges 28. The body board detent 9 is pressed upward into the channel space 17 while the fixing device 30 is slidably attached to the t-rail. After the fixing device 30 is fully attached to the t-rail, the detent 9 is released. Due to the elasticity of the material of the body board 10, the detent 9 will spring back downwardly away from the channel space 17 and blocking the fixing device at the t-rail proximal end 26. The fixing device bottom element 34 and front and rear lower portions 41 are inserted into the tool socket opening 3 wherein the fixing element circular protrusions 38 engage the tool socket opening indentations.

It is understood that the above-described embodiment is merely illustrative of the application. Other embodiments may be readily devised by those skilled in the art which will embody the principles of the invention and fall within the spirit and scope thereof.

I claim:

1. A hangtag for a tool socket having a generally cylindrical shape and having a central vertical opening for attachment to a tool socket holder, the central vertical opening having a semi-spherical indentation for engagement to a spherical spring in a tool socket holder, comprising:

a fixing device adapted to being inserted into and holding the tool socket;

a body board connected to said fixing device, said body board being a planar element adapted to being displayed in a vertical plane, said body board having a top, a bottom, two opposite sides, a front surface, an opposite rear surface, and an elongated slot formed in the body board near to the body board top, said elongated slot providing means for hooking the body board onto a display rack, said body board bottom terminating in a t-rail having a top, a foot, and a web interconnecting said t-rail top and foot, said t-rail having a proximal end and a distal end, a t-rail width being defined by a distance between the proximal end and distal end, said foot having a bottom flange formed thereon, said t-rail having a horizontal linear ridge on both body board surfaces along the t-rail top, said horizontal linear ridge being parallel to the t-rail foot, said t-rail distal end having a vertical ridge formed on both body board surfaces interconnecting said t-rail top and said foot bottom flange, said body board having a horizontal channel near to the body board bottom adjacent the t-rail proximal end, said horizontal channel opening vertically downward to the body board bottom alongside the t-rail proximal end, said horizontal channel terminating in a body board bottom tab detent;

wherein said hangtag is adapted to being displayed vertically with said body board being removably attached to a display rack hook and said fixing device holding the tool socket being attached to and suspended beneath the body board.

2. A hangtag for a tool socket as recited in claim 1, wherein:

the fixing device is comprised of a front element, rear element, top, bottom element, and two open sides, said front, rear, top and bottom defining a fixing device interior, said fixing device top being split with a central aperture extending from one open side to the other open side, said fixing device front element having a generally rectangular shape extending vertically downward a designated distance to the fixing device bottom element, said fixing device rear element having a generally rectangular shape extending vertically downward a designated distance less than that of the fixing device front element, said fixing device bottom element slanting upward from the fixing device front element to the fixing device rear element, said fixing device front element and rear element each having an external circular protrusion corresponding to a typical tool socket indentation within a tool socket opening.

3. A hangtag for a tool socket as recited in claim 2, wherein:

the fixing device front element and rear element have upper portions and lower portions, said circular protrusions being formed on the lower portions;

wherein the lower portions are inserted into the tool socket opening.

4. A hangtag for a tool socket as recited in claim 3, wherein:

wherein the fixing device top central aperture is slidably attached onto the t-rail web, wherein said fixing device top is fitted between the t-rail horizontal ridges and flange, wherein said fixing device top is horizontally held in place by the t-rail vertical ridges, wherein the body board bottom tab detent blocks the fixing device at the t-rail proximal end.

5. A hangtag for a tool socket as recited in claim 4, wherein:

the fixing device bottom element and front and rear lower portions are inserted into the tool socket opening wherein the fixing element circular protrusions engage the tool socket opening indentations.

6. A hangtag for a tool socket as recited in claim 5, wherein:

the body board has a vertical convex shape so that the front surface is bent outwardly.

7. A hangtag for a tool socket as recited in claim 6, wherein:

the fixing device interior has a triangular bracing element interconnecting the fixing device bottom element and front element.

* * * * *